United States Patent [19]

Canetta

[11] 4,456,197

[45] Jun. 26, 1984

[54] YARN FEEDER

[76] Inventor: Thomas J. Canetta, 3 Susan St., Cottekill, N.Y. 12419

[21] Appl. No.: 424,898

[22] Filed: Sep. 28, 1982

[51] Int. Cl.[3] ..... B65H 49/02; D03J 5/08

[52] U.S. Cl. ..... 242/130.4; 242/139

[58] Field of Search ..... 242/128, 129.5, 130, 242/130.1, 130.4, 136, 139, 141, 104, 115; 248/169–173, 439; 108/121, 125, 128, 132

[56] References Cited

U.S. PATENT DOCUMENTS

| | | | |
|---|---|---|---|
| 1,539,016 | 5/1925 | Mizuno | 242/110 |
| 2,162,294 | 6/1939 | Baldwin | 248/169 |
| 2,215,410 | 9/1940 | Salter | 242/139 |
| 2,254,468 | 9/1941 | Benson | 242/130 |
| 2,261,943 | 11/1941 | Rogers | 242/104 |
| 2,545,790 | 3/1951 | Newmaker | 242/115 |

*Primary Examiner*—Leonard D. Christian
*Attorney, Agent, or Firm*—John Maier, III

[57] ABSTRACT

A yarn feeder with a pair of rotatable discs mounted on bearings for resistant free rotation of the disc with a spindle being rigidly mounted in the center of each disc for holding yarn in place on each disc and foldable finger-like members rotatably mounted on the yarn feeder for supporting the yarn feeder when in use.

7 Claims, 6 Drawing Figures

YARN FEEDER

BACKGROUND OF THE INVENTION

The present invention relates to a yarn feeder, and more particularly for a yarn feeder for the ready feeding of two different yarns while being readily foldable for storage.

Yarn feeders have previously been known in the art. Some have included complex stands. However, such a unit, in order to be practical, must permit easy rotation of the yarn so as not to pull or interfere with the use of the yarn and such a device must be readily foldable for easy storage.

In accordance with this invention, a yarn feeder is provided with ideal qualities for supplying the yarn which is readily foldable for compact storage.

SUMMARY OF THE INVENTION

The present invention provides an improved yarn feeder in which the above-described problems are eliminated.

In accordance with this invention, a base plate is provided with a pair of tubes mounted in it. A pair of finger-like members are rotatably mounted on the tubes on one side of the base plate. The finger-like members are also adapted to fit together to form a member substantially the same size and shape as the base plate. A pair of discs are rotatably mounted on the pair of tubes and spindles are provided in the tubes.

In operation the finger-like members can be swung out to form a firm and secure base. The yarn is mounted on the spindles with the lower end of the yarn resting on its respective disc.

DESCRIPTION OF THE DRAWINGS

The present invention may be better understood and its numerous advantages will become apparent to those skilled in the art by reference to the accompanying drawings wherein like reference numerals refer to like elements in the various figures in which.

DETAILED DESCRIPTION OF THE INVENTION

Figure 4:
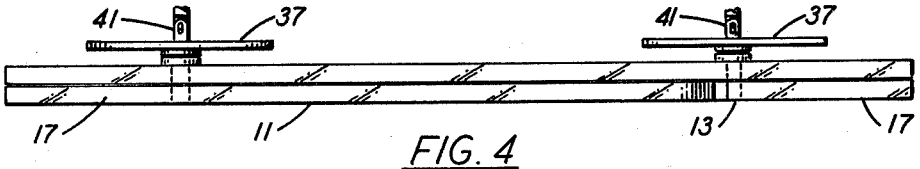
FIG. 4 is a side elevation of the yarn feeder.
Figure 3:
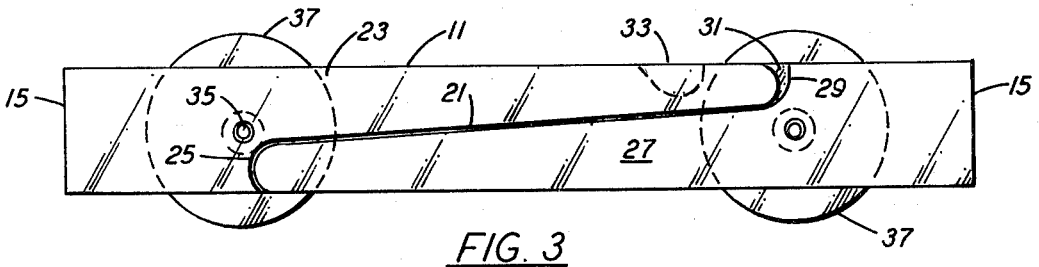
FIG. 3 is a plan view with both finger-like units folded together and with the yarn feeder turned upside down with the finger-like members on top.
Figure 1:
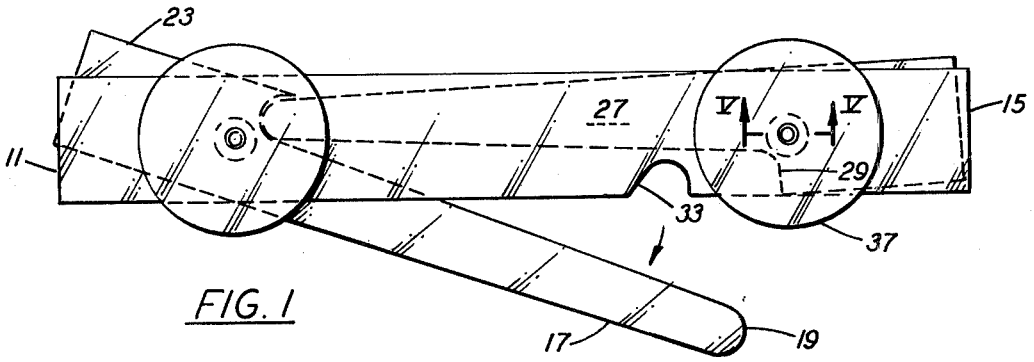
FIG. 1 is a plan view showing the knitting yarn feeder with one of the finger-like members partially pulled out.
Figure 2:
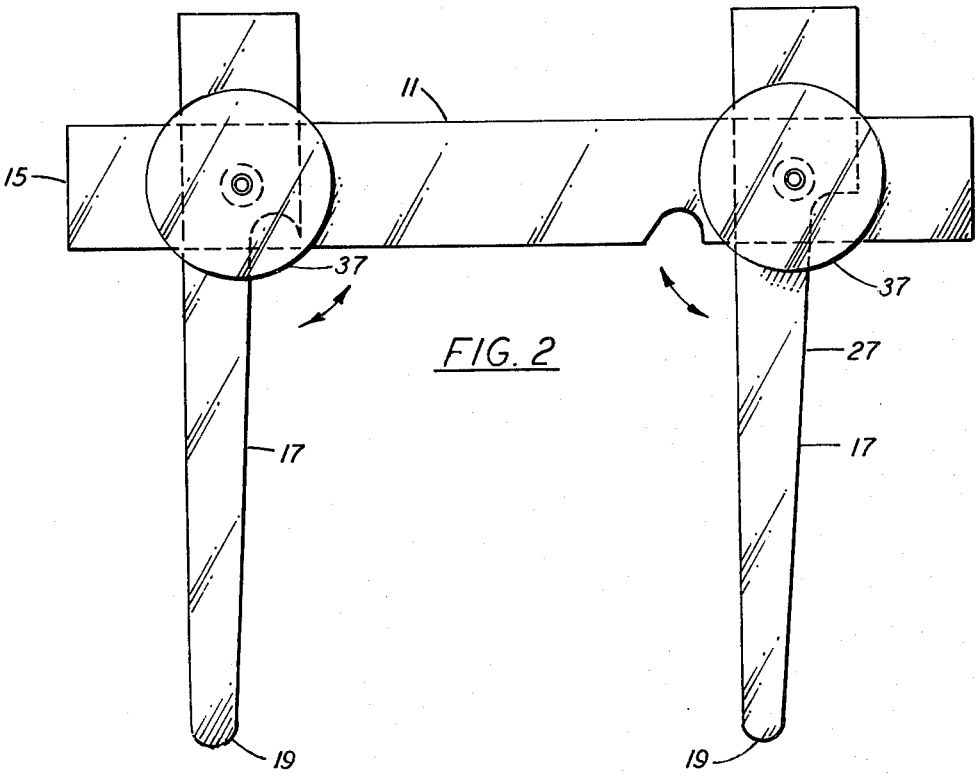
FIG. 2 is a plan view showing both finger-like members completely open so as to support the yarn feeder.

The yarn feeder, as is best seen in FIGS. 1, 2 and 3, includes a base plate 11. The base plate 11 is rectangular in shape and the major axis of the base plate 11 is substantially longer than the minor axis.

On one side of the base plate 11, a pair of tubes 13 are rigidly mounted in the base plate 11. Each of the tubes 13 extend from the two major areas of the face plate substantially at right angles to the surfaces. Both of the tubes 13 are located substantially along the major axis of the base plate 11 or centerline of the major face area and are equally distant from the shorter ends 15 of the base plate 11. Each tube 13 has a concentric opening 16 through it.

A pair of finger-like members 17 are provided so as to be foldable under the base plate 11 and to be rotated outwardly as best seen in FIG. 2 when the yarn feeder is to be used. Referring to FIG. 3, the pair of finger-like members 17 are formed from a rectangular sheet substantially the same size and shape as the base plate 11, with the finger-like members each being substantially the same length with rounded ends 19 and with their interfacing edges 21 at an acute angle to the longitudinal axis of the base plate 11.

As best seen in FIG. 1, one finger-like member 23 of the pair of finger-like members 17, has a semi-circular socket 25 to retain the rounded end 19 of the other finger-like member 27. In this way, when the first finger-like member 23 is pulled out it causes the second finger-like member 27 to follow. The finger-like member 27 which follows the finger-like member 23 has an open socket 29 with clearance 31 so that the first finger-like member 23 can be readily rotated outwardly.

In the base plate 11 a small rounded cut out 33 is provided so that the first finger-like member 23, which is not retained, can be easily gripped on both its top and bottom surfaces and rotated outwardly. In doing so, the second finger-like member 27 is also forced outwardly by the semi-circular socket 25 of the first finger-like member 23.

At the opposite side of the base plate 11 from the pair of finger-like members 17, bearings 35 are mounted on the tubes 13 and a pair of discs 37, each having a diameter slightly greater than the minor dimension of the base plate 11, is rotatably mounted on the bearings 35. The bearings 35 are preferably ball bearings.

A pair of spindles 39 are rigidly placed in each of the tubes 13 in the concentric opening. Each spindle 39, which is preferably needle-like in form, similar to a knitting needle, extends upwardly from one of the discs 37. Each spindle has a lower portion 40, of reduced diameter which extends into the tube 13. The spindle 39 is rigidly mounted in the tube 13 which in turn is rigidly mounted in the base plate and does not rotate. The spindle 39 offers very limited resistance to the rotation of the yarn which otherwise spins freely with the disc 37 on which it rests.

Figure 6:
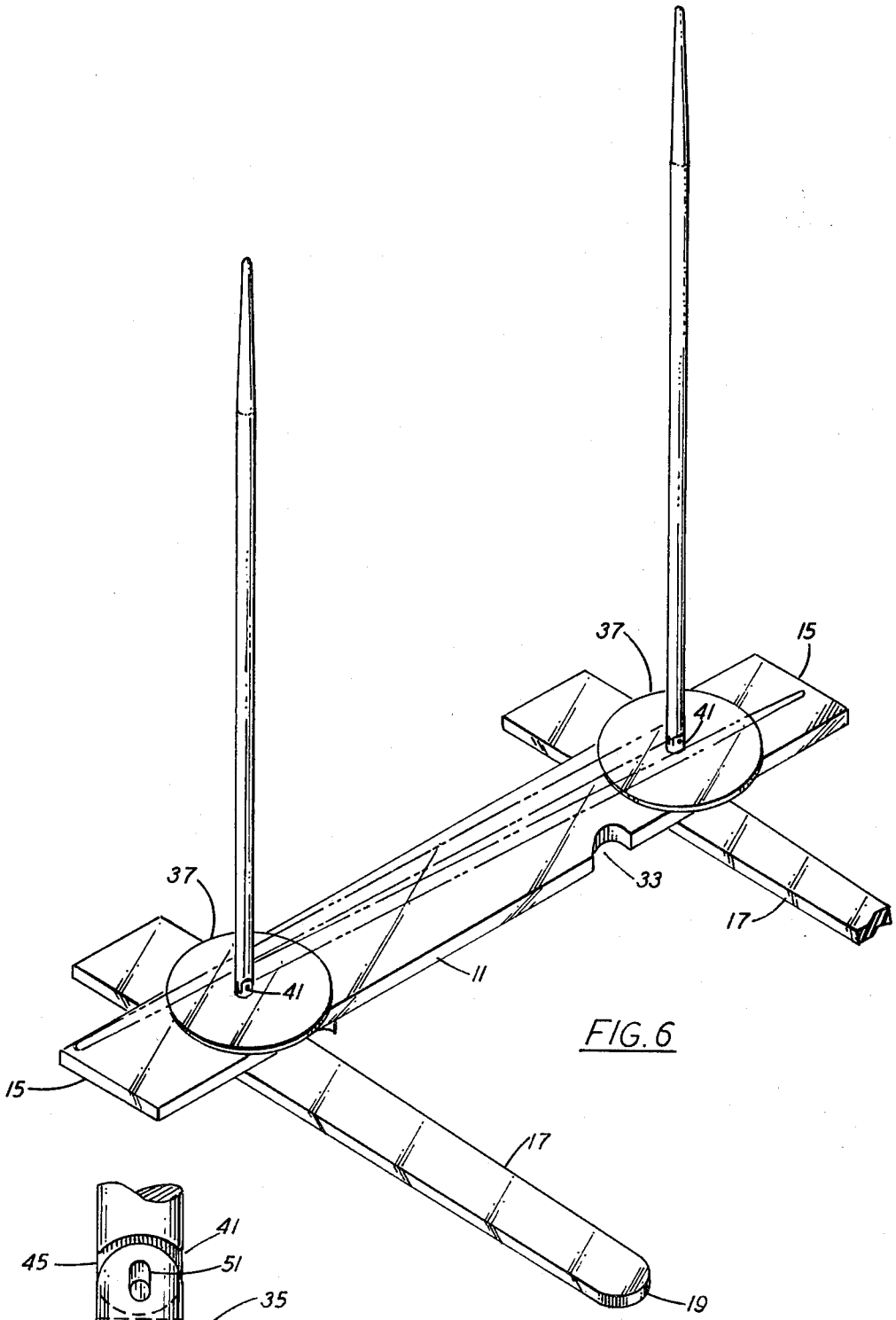
FIG. 6 is a partial side elevation of one spindle showing the flexible joint for bending the spindle over when in storage.
Figure 5:
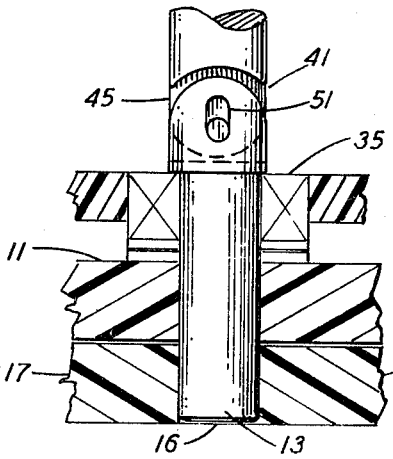
FIG. 5 is a partial cross-sectional view along lines 5—5 of FIG. 1.

Each of the pair of spindles 39 has a flexible joint 41 located immediately above its respective disc 37. As best seen in FIG. 6, the flexible joint 41 permits rotation of the upper portion 43 of the spindles 39 downwardly onto the base plate 11. The upper portion 43 of each spindle 39 has a tongue 45 which locks into the lower portion 47 of the spindle 39. The tongue 45 has a pair of pins 49 in each side which are rotatable mounted in an elongated slot 51 permitting the upper portion 43 to be pulled upwardly thus permitting the upper portion 43 to be folded over.

For purposes of storage, it can be readily seen that the pair of finger-like members 17 can be folded together beneath the base plate 11 for ready storage and the spindles 39 can be folded downwardly. In one embodiment, the spindles 39 may be just removed and stored with the base plate. However, to avoid loss, it is preferable that the spindles 39 be retained inside the openings 14 in the tube 13 and that the flexible joint 41 be provided in the spindles 39, as best seen in FIG. 6, so that the spindles 39 when not in use, can be bent down. In this way, the yarn feeder takes very little storage space, does not come apart and can be stored in a very limited space with very little effort and without disassembly of the parts while providing easy rotation of the yarn for ready feeding of the yarn without pulling.

While a preferred embodiment has been shown and described, various modifications and substitutions may be made without departing from the spirit and scope of this invention. Accordingly, it is understood that this invention has been described by way of illustration rather than limitation.

I claim:

1. A yarn feeder comprising:

a base plate substantially rectangular in shape with a major axis and a minor axis, said major axis being substantially longer than said minor axis;

a pair of tubes rigidly mounted in said base plate, said tubes having a concentric opening extending through them, each of said tubes extending beyond both opposite sides of said base plate;

a pair of finger-like members, each located on one side of said base plate and each rotatably mounted on one of said tubes, said finger-like members being adapted to fit together to form a rectangular member substantially the same size and shape as said base plate;

a pair of bearings, one of said bearings being located on each of said tubes on the side of said base plate opposite from said pair of finger-like members;

a pair of discs rotatably mounted on said bearings; and a pair of spindles, each detachable mounted in one of said tubes and extending substantially above said pair of discs.

2. A yarn feeder according to claim 1 wherein both of said tubes are located substantially along said major axis and each of said tubes is located substantially equidistant from the opposite ends of said base plate.

3. A yarn feeder according to claim 1 wherein said spindles include a flexible joint adjacent its respective disc.

4. A yarn feeder according to claim 1 wherein said base plate has a cut-out so that one finger-like member can be pulled out from beneath the base plate.

5. A yarn feeder according to claim 1 wherein one of the finger-like members includes a semi-circular socket and the other finger-like member has a rounded end adapted to fit in said semi-circular socket.

6. A yarn feeder according to claim 1 wherein the pair of discs have substantially the same diameter, said diameter being larger than the minor axis of said base plate.

7. A yarn feeder according to claim 1 wherein said pair of bearings are ball bearings.

* * * * *